US010598111B2

(12) United States Patent
Imai et al.

(10) Patent No.: US 10,598,111 B2
(45) Date of Patent: Mar. 24, 2020

(54) FUEL INJECTION CONTROLLER AND CONTROLLING METHOD FOR ENGINE

(71) Applicant: TOYOTA JIDOSHA KABUSHIKI KAISHA, Toyota-shi (JP)

(72) Inventors: Sohichi Imai, Toyota (JP); Masanao Idogawa, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/185,032

(22) Filed: Nov. 9, 2018

(65) Prior Publication Data

US 2019/0162125 A1 May 30, 2019

(30) Foreign Application Priority Data

Nov. 30, 2017 (JP) ..... 2017-230877

(51) Int. Cl.

| | |
|---|---|
| ***F02D 41/14*** | (2006.01) |
| ***F02D 41/30*** | (2006.01) |
| ***F02D 41/24*** | (2006.01) |
| ***F02D 41/00*** | (2006.01) |
| *F02D 41/02* | (2006.01) |

(52) U.S. Cl.

CPC ..... *F02D 41/1408* (2013.01); *F02D 41/0085* (2013.01); *F02D 41/1454* (2013.01); *F02D 41/2454* (2013.01); *F02D 41/2458* (2013.01); *F02D 41/30* (2013.01); *F02D 41/024* (2013.01); *F02D 2041/0265* (2013.01)

(58) Field of Classification Search

CPC ..... F02D 41/1408; F02D 41/0085; F02D 41/1454; F02D 41/2454; F02D 41/2458; F02D 41/30; F02D 41/024; F02D 41/1486; F02D 41/1487; F02D 2041/0265

USPC ..... 123/299, 300, 672, 673, 674, 676, 704; 701/103–105, 109; 60/274, 276, 285; 73/114.71, 114.72, 114.73

See application file for complete search history.

(56) References Cited

U.S. PATENT DOCUMENTS

| | | | | |
|---|---|---|---|---|
| 4,850,326 | A | 7/1989 | Tomisawa | |
| 5,315,823 | A | 5/1994 | Nishikawa et al. | |
| 8,554,450 | B2 * | 10/2013 | Takada | F02D 41/1441 123/672 |

(Continued)

FOREIGN PATENT DOCUMENTS

| | | | |
|---|---|---|---|
| DE | 11 2009 004 382 | T5 | 6/2012 |
| DE | 10 2015 118 462 | A1 | 5/2016 |

(Continued)

*Primary Examiner* — Hai H Huynh
*Assistant Examiner* — Gonzalo Laguarda
(74) *Attorney, Agent, or Firm* — Oblon, McClelland, Maier & Neustadt, L.L.P.

(57) ABSTRACT

A fuel injection controller updates an air-fuel ratio learning value such that the amount of correction of a fuel injection amount according to an air-fuel ratio feedback correction value approaches zero. Further, the fuel injection controller makes an update rate of the air-fuel ratio learning value lower when the variation among respective-cylinder correction values, which are set for the respective cylinders in order to differentiate air-fuel ratios of a plurality of cylinders, is great than when the variation among the respective-cylinder correction values of the cylinders is small.

6 Claims, 3 Drawing Sheets

(56) References Cited

U.S. PATENT DOCUMENTS

| | | | | |
|---|---|---|---|---|
| 8,600,647 | B2 * | 12/2013 | Demura | F02D 41/2454 123/674 |
| 9,932,922 | B2 * | 4/2018 | McEwan | F02D 41/0085 |
| 2012/0006307 | A1 | 1/2012 | Demura | |
| 2013/0073181 | A1 * | 3/2013 | Mamada | F02D 28/00 701/103 |
| 2015/0128567 | A1 | 5/2015 | Kondo et al. | |
| 2016/0123257 | A1 | 5/2016 | McEwan | |

FOREIGN PATENT DOCUMENTS

| | | | |
|---|---|---|---|
| EP | 0 265 079 | A2 | 4/1988 |
| JP | 11-287145 | | 10/1999 |
| JP | 2004-225559 | | 8/2004 |
| JP | 2004-360562 | | 12/2004 |
| JP | 2013-076362 | | 4/2013 |
| JP | 2013-249792 | | 12/2013 |
| JP | 2015-169185 | | 9/2015 |

* cited by examiner

FUEL INJECTION CONTROLLER AND CONTROLLING METHOD FOR ENGINE

BACKGROUND

The present disclosure relates to a fuel injection controller and a controlling method for an engine.

There is known a fuel injection controller for an engine in which feedback control of a fuel injection amount is performed such that an exhaust air-fuel ratio, which is detected by an air-fuel ratio sensor installed in an exhaust passage, approaches a target air-fuel ratio, and learns as an air-fuel ratio learning value a correction amount of a fuel injection amount required for achieving a target air-fuel ratio based on the result of the feedback control. Further, as seen in Japanese Laid-Open Patent Publication No. 11-287145, there is known an air-fuel ratio controller that maintains an air-fuel ratio of an entire engine provided with a plurality of cylinders at a target air-fuel ratio and corrects fuel injection amounts of the respective cylinders to differentiate air-fuel ratios of air-fuel mixture burned in the cylinders.

When the correction for respective cylinders as described above is in operation, the exhaust air-fuel ratio keeps fluctuating with the target air-fuel ratio at the center. Thus, when air-fuel ratio learning is performed while the correction for respective cylinders is in operation, an air-fuel ratio learning value fluctuates with the exhaust air-fuel ratio. Deterioration in convergence of air-fuel ratio learning values due to the correction for respective cylinders can be prevented by evenly prohibiting or limiting the air-fuel ratio learning when the correction for respective cylinders is in operation. However, this causes a delay in completion of learning of the air-fuel ratio learning value.

SUMMARY

An objective of the present invention is to provide a fuel injection amount controller and controlling method for an engine that are capable of favorably learning an air-fuel ratio even when correction of fuel injection amounts of respective cylinders is in operation.

In accordance with a first aspect of the present disclosure, a fuel injection controller for an engine is provided. The engine includes a plurality of cylinders and a plurality of fuel injection valves provided respectively in the cylinders. The fuel injection controller is configured to control each of fuel injection amounts of the fuel injection valves. The fuel injection controller is configured to have, as correction values for fuel injection amounts of the fuel injection valves: an air-fuel ratio feedback correction value, which is updated such that a difference between an exhaust air-fuel ratio, which is detected by an air-fuel ratio sensor installed in an exhaust passage, and a target air-fuel ratio approaches zero; an air-fuel ratio learning value, which is updated based on the air-fuel ratio feedback correction value such that an amount of correction of the fuel injection amount according to the air-fuel ratio feedback correction value approaches zero; and respective-cylinder correction values, which are set for the respective cylinders to differentiate the air fuel ratios of the cylinders. The fuel injection controller is configured to make an update rate of the air-fuel ratio learning value lower when a variation among the respective-cylinder correction values of the cylinders is great than when the variation among the respective-cylinder correction values of the cylinders is small.

In accordance with a second aspect of the present disclosure, a fuel injection controller for an engine is provided.

The engine includes a plurality of cylinders and a plurality of fuel injection valves provided respectively in the cylinders. The fuel injection controller comprising circuitry that is configured to: control each of fuel injection amounts of the fuel injection valves. The circuitry is also configured to have, as correction values for fuel injection amounts of the fuel injection valves: an air-fuel ratio feedback correction value, which is updated such that a difference between an exhaust air-fuel ratio, which is detected by an air-fuel ratio sensor installed in an exhaust passage, and a target air-fuel ratio approaches zero; an air-fuel ratio learning value, which is updated based on the air-fuel ratio feedback correction value such that an amount of correction of the fuel injection amount according to the air-fuel ratio feedback correction value approaches zero; and respective-cylinder correction values, which are set for the respective cylinders to differentiate the air fuel ratios of the cylinders. The circuitry is further configured to make an update rate of the air-fuel ratio learning value lower when a variation among the respective-cylinder correction values of the cylinders is great than when the variation among the respective-cylinder correction values of the cylinders is small.

In accordance with a third aspect of the present disclosure, a fuel injection controlling method for an engine is provided. The engine includes a plurality of cylinders and a plurality of fuel injection valves provided respectively in the cylinders. The method includes controlling each of fuel injection amounts of the fuel injection valves and having, as correction values for fuel injection amounts of the fuel injection valves: an air-fuel ratio feedback correction value, which is updated such that a difference between an exhaust air-fuel ratio, which is detected by an air-fuel ratio sensor installed in an exhaust passage, and a target air-fuel ratio approaches zero; an air-fuel ratio learning value, which is updated based on the air-fuel ratio feedback correction value such that an amount of correction of the fuel injection amount according to the air-fuel ratio feedback correction value approaches zero; and respective-cylinder correction values, which are set for the respective cylinders to differentiate the air fuel ratios of the cylinders. The method further comprises making an update rate of the air-fuel ratio learning value lower when a variation among the respective-cylinder correction values of the cylinders is great than when the variation among the respective-cylinder correction values of the cylinders is small.

Other aspects and advantages of the present disclosure will become apparent from the following description, taken in conjunction with the accompanying drawings, illustrating exemplary embodiments.

BRIEF DESCRIPTION OF THE DRAWINGS

The disclosure may be understood by reference to the following description together with the accompanying drawings.

DETAILED DESCRIPTION

A fuel injection controller for an engine according to one embodiment will now be described with reference to FIGS. 1 to 4. The fuel injection controller of the present embodiment is employed in a vehicle engine 10.

Figure 1:
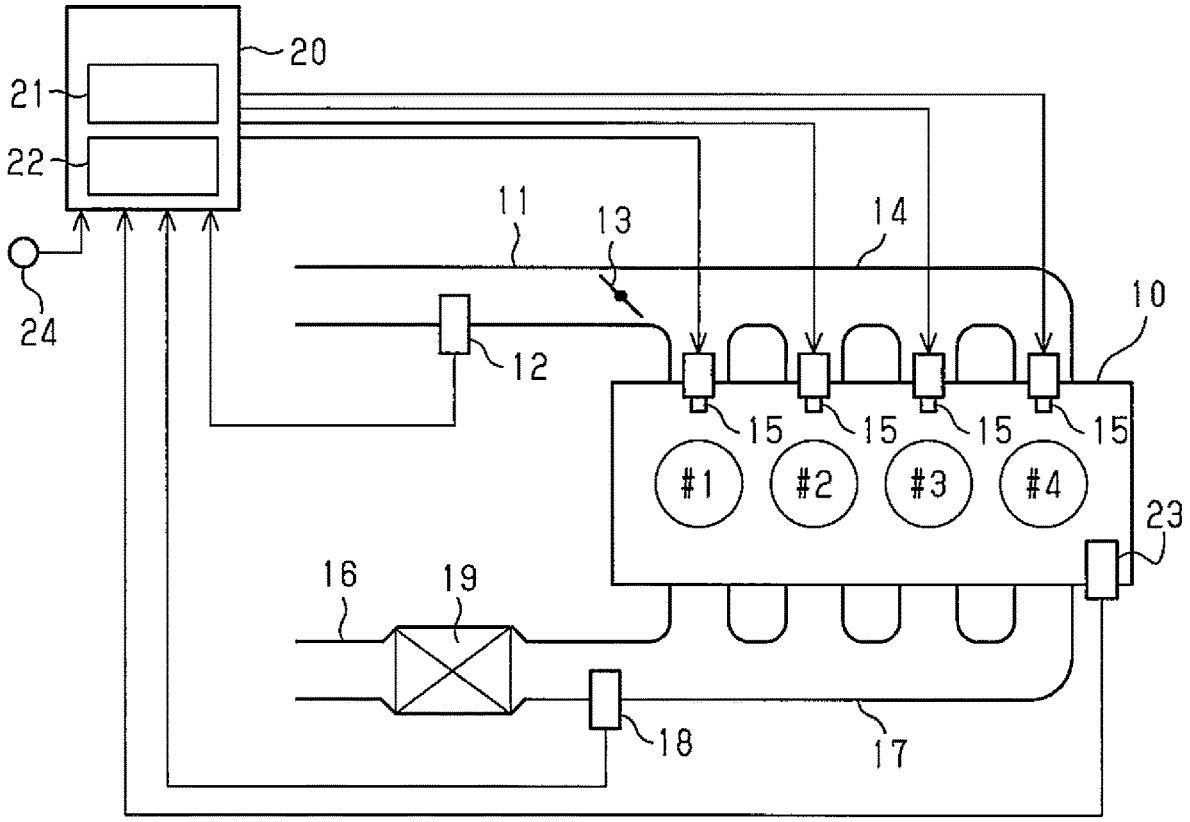
FIG. 1 is a schematic view showing the configuration of an intake and exhaust system of an engine in which a fuel injection controller according to one embodiment of the present invention is employed.

As shown in FIG. 1, the engine 10 is an inline four cylinder engine provided with four cylinders #1 to #4 arrayed in series. An intake passage 11 is provided with an air flow meter 12 for detecting an intake air flow rate (intake air amount) flowing in an intake passage 11 and a slot valve 13 for adjusting an intake air amount GA. The intake passage 11 downstream of the slot valve 13 is provided with an intake manifold 14 being a branched tube for branching the intake air for the respective cylinders. The engine 10 is provided with four fuel injection valves 15 for each injecting a fuel into the intake air branched for the respective cylinders in the intake manifold 14. The fuel injection valve 15 is provided in each of the cylinders #1 to #4.

The exhaust passage 16 is provided with an exhaust manifold 17 being a collecting tube that collects exhaust gas of each of the cylinders #1 to #4. The exhaust passage 16 downstream of the exhaust manifold 17 is provided with an air-fuel ratio sensor 18 for detecting the air-fuel ratio of air-fuel mixture burned in each of the cylinders #1 to #4. Further, a catalyst device 19 for purifying the exhaust gas is installed in the exhaust passage 16 downstream of the air-fuel ratio sensor 18. As the catalyst device 19, a three-way catalyst device is employed that is capable of most effectively purifying the exhaust gas when the air-fuel ratio of the air-fuel mixture burned in each of the cylinders #1 to #4 is the stoichiometric air fuel ratio.

The engine 10 is controlled by an electronic control unit 20 made up of a microcomputer including an arithmetic processing circuit 21 and a memory 22. The electronic control unit 20 is not limited to one that performs software processing on all processes executed by itself. For example, the electronic control unit 20 may include at least part of the processes executed by the software in the present embodiment as one that is executed by hardware circuits dedicated to execution of these processes (such as ASIC). That is, the electronic control unit 20 may be modified as long as it has any one of the following configurations (a) to (c). (a) A configuration including a processor that executes all of the above-described processes according to programs and a program storage device such as a ROM that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

In addition to detection signals from the air flow meter 12 and the air-fuel ratio sensor 18, the electronic control unit 20 receives inputs of detection signals from a crank angle sensor 23, which outputs a pulse signal each time the crankshaft, or the output shaft, of the engine 10 rotates by a predetermined angle and an accelerator position sensor 24, which detects the amount of depression on the accelerator pedal (accelerator position) by the driver. The electronic control unit 20 causes the arithmetic processing circuit 21 to read various programs for engine control stored in the memory 22 and execute the programs, thereby controlling the operation state of the engine 10. The electronic control unit 20 calculates the engine speed from the pulse signal of the crank angle sensor 23 as one of the above processes.

The arithmetic processing circuit 21 is activated in accordance with an on-operation of the ignition switch by the driver and stops in accordance with an off-operation of the ignition switch. In contrast, the memory 22 remains energized even after the off-operation of the ignition switch, so that the memory 22 can hold necessary data even while the operation of the arithmetic processing circuit 21 is suspended.

The electronic control unit 20 controls the fuel injection amount of the fuel injection valve 15 in each of the cylinders #1 to #4 as part of the engine control. That is, the electronic control unit 20 corresponds to the fuel injection controller that controls the fuel injection amount of the fuel injection valve 15 in each of the cylinders #1 to #4; of the engine 10.

Figure 2:
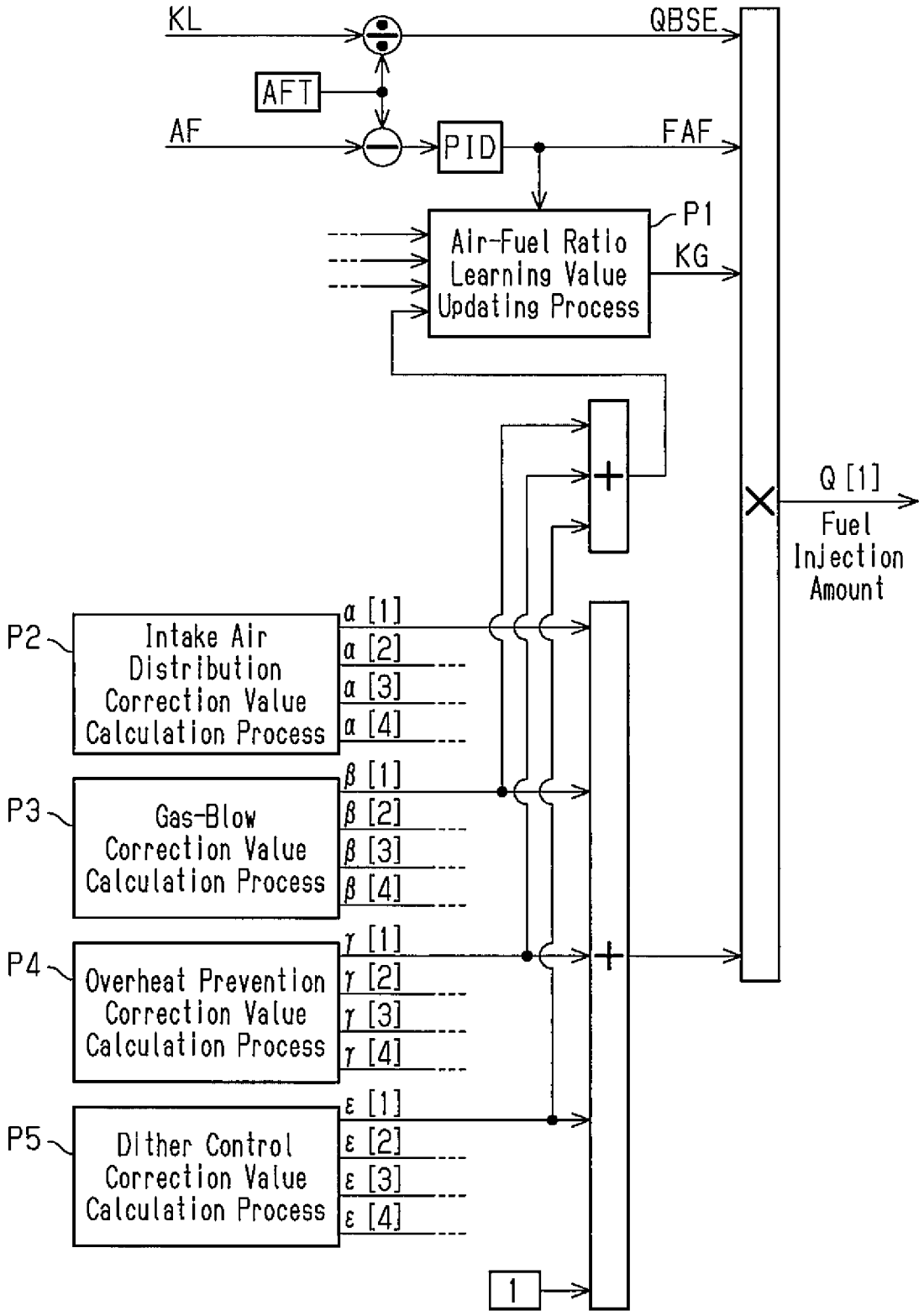
FIG. 2 is a block diagram showing the flow of fuel injection amount calculation process.

FIG. 2 shows the flow of processes according to calculation of the fuel injection amounts. Herein, the fuel injection amounts are calculated for the respective cylinders. FIG. 2 shows a calculation process for the fuel injection amount of the cylinder #1 as an example. The fuel injection amounts of the other cylinders #2 to #4 are calculated in similar flows to that for the cylinder #1. In the present specification and drawings, in a parameter set for the respective cylinders, the number of the corresponding cylinder is placed in square brackets added to the end of a symbol. For example, a fuel injection amount Q[1] represents the fuel injection amount of the cylinder #1, and a fuel injection amount Q[2] represents the fuel injection amount of cylinder #2. Further, when "i" is placed in the square brackets that are added to the end of the symbol, the parameter is represented as a parameter of an arbitrary cylinder out of the cylinders #1 to #4. The letter "i" represents any of 1, 2, 3, and 4.

In calculation of the fuel injection amount, first, a base injection amount QBSE is calculated. Specifically, the quotient obtained by dividing a cylinder intake air amount KL by a target air-fuel ratio AFT, which is a target value of the air-fuel ratio, is calculated as a base injection amount QBSE. The cylinder intake air amount KL is a calculated value of the amount of an air to be supplied for burning in each of the cylinders #1 to #4. The cylinder intake air amount KL is obtained based on the intake air amount detected by the air flow meter 12 and the engine rotation speed calculated from the pulse signal of the crank angle sensor 23.

Further, a value obtained by performing a PID process on a difference obtained by subtracting the target air-fuel ratio AFT from the exhaust air-fuel ratio AF detected by the air-fuel ratio sensor 18, is calculated as an air-fuel ratio feedback correction value FAF. The air-fuel ratio feedback correction value FAF is initialized to 1 at the activation of the arithmetic processing circuit 21.

Based on the air-fuel ratio feedback correction value FAF, an air-fuel ratio learning value updating process PI for updating an air-fuel ratio learning value KG is performed. The detail of the air-fuel ratio learning value updating process P1 will be described later. The air-fuel ratio learning value KG remains held in the memory 22 even after the off-operation of the ignition switch. Hence the air-fuel ratio learning value KG is not initialized at the activation of the arithmetic processing circuit 21, and the air-fuel ratio learning value KG at the time of the off-operation of the ignition switch is taken over at the activation of the arithmetic processing circuit 21.

The base injection amount QBSE, the air-fuel ratio feedback correction value FAF, and the air-fuel ratio learning value KG are values in common among the cylinders #1 to #4. In the present embodiment, as respective-cylinder correction values for fuel injection amount, an intake air distribution correction value α[i], a gas-blow correction value β[i], an overheat prevention correction value γ[i], and a dither control correction value ε[i] are calculated. Different values are set for each cylinder as the intake air distribution correction value α[i], the gas-blow correction value β[i], the overheat prevention correction value γ[i], and the dither control correction value ε[i]. Further, the above respective-cylinder correction values are set as a ratio of fuel injection correction amount with respect to the base injection amount QBSE. The respective-cylinder correction value in this case becomes a positive value in the case of correcting the fuel injection amount to an amount increasing side, and the respective-cylinder correction value becomes a negative value in the case of correcting the fuel injection amount to an amount decreasing side.

Intake Air Distribution Correction Value

The intake air distribution correction value α[i] is a respective-cylinder correction value for fuel injection amount for compensating a deviation of the air-fuel ratio among the cylinders due to variation in intake air distribution in the intake manifold 14. The intake air distribution correction value α[i] is calculated by an intake air distribution correction value calculation process P2. The variation in intake air distribution among the cylinders for each operation region of the engine 10 is measured on the stage of designing the engine 10. Hence the respective-cylinder correction value for each of the cylinders #1 to #4 required for compensating the deviation of the air-fuel ratio due to the variation in intake air distribution is obtained in advance from the measurement result in the design stage. The memory 22 stores in a map the intake air distribution correction value α[i] of each of the cylinders #1 to #4 for each operation region. In the intake air distribution correction value calculation process P2, the intake air distribution correction value α[i] of each of the cylinders #1 to #4 in the current operation state is calculated with reference to the map.

Gas-Blow Correction Value

There are individual differences in injection characteristics of the fuel injection valve 15. For this reason, even when injecting the same amount of fuel to each cylinder is instructed, there occurs variation in amount of actually injected fuel. Further, the strength of exhaust gas blowing against the air-fuel ratio sensor 18 differs depending on the cylinder. Hence a result of burning of a cylinder with strong gas blow is easily reflected on the air-fuel ratio feedback correction value FAF. For example, there may be installed the fuel injection valve 15 that injects a fuel in a larger amount than an instructed amount to the cylinder with strong gas blow. In this case, the detection result for the exhaust air-fuel ratio of the air-fuel ratio sensor 18 tends to show a richer value than an average value of the air-fuel ratios of the respective cylinders #1 to #4. If the air-fuel ratio is fed back in accordance with this detection result as it is, the air-fuel ratio of the engine 10 regularly deviates to the lean side. As thus described, the difference among the cylinders in strength of exhaust gas blowing against the air-fuel ratio sensor 18 causes a regular deviation of the air-fuel ratio with respect to the target air-fuel ratio.

The gas-blow correction value β[i] is a respective-cylinder correction value for preventing the regular deviation of the air-fuel ratio that occurs due to the difference in gas blow strength among the cylinders. The gas-blow correction value β[i] is calculated by a gas-blow correction value calculation process P3. In the gas-blow correction value calculation process P3, the gas-blow correction value β[i] of each of the cylinders #1 to #4 is obtained with reference to the map stored in the memory 22. The gas-blow correction value β[i] of each of the cylinders #1 to #4 is stored for each operation region of the engine 10. The gas-blow correction value β[i] of each of the cylinders #1 to #4 is set such that the actual air-fuel ratio of the cylinder with the strongest gas blow becomes the target air-fuel ratio and that the total of the gas-blow correction values β[i] of the cylinders #1 to #4 becomes zero. For example, when there is a tendency that the air-fuel ratio of the cylinder with the strongest gas blow deviates to the lean side, a value for correcting and increasing the fuel injection amount is set in the cylinder with the strongest gas blow, and a value for correcting and decreasing the fuel injection amount is set in each of the remaining cylinders, as the gas-blow correction values β[i]. In contrast, when there is a tendency that the air-fuel ratio of the cylinder with the strongest gas blow deviates to the rich side, a value for correcting and decreasing the fuel injection amount is set in the cylinder with the strongest gas blow, and a value for correcting and increasing the fuel injection amount is set in each of the remaining cylinders, as the gas-blow correction values β[i]. The correction of the fuel injection amount for the respective cylinders is made using the gas-blow correction value β[i] as thus described, so that the regular deviation of the air-fuel ratio can be prevented by differentiating the air-fuel ratios of the respective cylinders #1 to #4 in accordance with the gas blow strengths.

Catalyst Overheat Prevention Correction Value

Erosion of the catalyst device 19 due to overheating can be prevented by discharging exhaust gas containing a large amount of unburned fuel due to rich combustion, in which the air-fuel ratio is made richer than the target air-fuel ratio, to the exhaust passage 16 and decreasing the temperature of the exhaust gas by the heat of evaporation of the unburned fuel. However, when the rich combustion is performed in all of the cylinders #1 to #4 of the engine 10, the exhaust gas purification efficiency in the catalyst device 19 deteriorates. In contrast, in the present embodiment, in the overheat prevention control that is performed when the temperature of the catalyst device 19 exceeds a preset value, the rich combustion is performed only in some of the cylinders, whereby it is possible to prevent a temperature rise of the catalyst device 19 while preventing deterioration in exhaust gas purification efficiency.

In addition, the longer the distance of the exhaust flow channel from the cylinder to the catalyst device 19, the more easily the unburned fuel is vaporized, and the more the exhaust gas cooling efficiency is enhanced. In the above engine 10, among the cylinders #1 to #4, the cylinder #4 is a cylinder with the longest exhaust flow channel to the catalyst device 19. Therefore, in the overheat prevention control of the catalyst device 19, the rich combustion is performed in the cylinder #4.

The overheat prevention correction value γ[i] is a respective-cylinder correction value for fuel injection amount for preventing the temperature rise of the catalyst device 19 in the overheat prevention control. The overheat prevention correction value γ[i] is calculated by an overheat prevention correction value calculation process P4. In the overheat prevention correction value calculation process P4, when the temperature of the catalyst device 19 estimated in accordance with the operation state of the engine 10 is lower than or equal to the preset value, the overheat prevention correction value γ[i] of each of all the cylinders #1 to #4 is set to 0. In contrast, when the temperature of the catalyst device 19 exceeds the preset value, the overheat prevention correction value γ[4] of the cylinder #4 in which the rich combustion is performed is set to a positive value, and the overheat prevention correction values γ[1], γ[2], and γ[3] of the remaining cylinders #1 to #3 is set to 0 (γ[1], γ[2], γ[3]=0, γ[4]>0). The higher the temperature of the catalyst device 19 becomes over the preset value, the larger the overheat prevention correction value γ[4] of the cylinder #4 becomes.

Dither Control Correction Value

In the present embodiment, a dither control for promoting the warming of the catalyst device 19 is performed immediately after the cold start of the engine 10. In the dither control, the rich combustion is performed in some of the cylinders #1 to #4, and the lean combustion is performed in the remaining cylinders. By the exhaust gas containing a large amount of excess oxygen in the cylinder in which the lean combustion has been performed, the catalyst device 19 is brought into a state where excess oxygen is present and an exhaust gas containing a large amount of an unburned fuel subjected to the rich combustion is fed for burning, to promote the temperature rise of the catalyst device 19.

The dither control is carried out through the correction of the fuel injection amount for the respective cylinders by using the dither control correction value ε[i]. The dither control correction value ε[i] is calculated by a dither control correction value calculation process P5. In the present embodiment, the rich combustion is performed in the cylinder #1 and the lean combustion is performed in the remaining cylinders #2 to #4. Except the time of execution of the dither control, the dither control correction values ε[i] of the respective cylinders #1 to #4 are all set to 0. In contrast, at the time of execution of the dither control, a dither control correction value ε[1] of the cylinder #1 in which the rich combustion is performed is set to a dither width Δ, which is a preset positive value. Further, dither control correction values ε[2], ε[3], ε[4] of the remaining cylinders #2 to #4 in which the lean combustion is performed are set to a value (−ΔA/3) obtained by dividing the dither width A by 3 and inverting the positive/negative of the obtained value.

Out of the four respective-cylinder correction values, the gas-blow correction value β[i], the overheat prevention correction value γ[i], and the dither control correction value ε[i] are respective-cylinder correction values for differentiating the air-fuel ratios of the respective cylinders #1 to #4. In contrast, the intake air distribution correction value α[i] is a respective-cylinder correction value for compensating the variation in air-fuel ratio among the cylinders due to the variation in intake air distribution. That is, the intake air distribution correction value α[i] is different from the other three respective-cylinder correction values in that the air-fuel ratios of the respective cylinders #1 to #4 are not differentiated.

Calculation of Fuel Injection Amount

The fuel injection amount Q[i] of each of the cylinders #1 to #4 is calculated so as to satisfy the relationship of an expression (1). First, for each cylinder, the total of the intake air distribution correction value α[i], the gas-blow correction value β[i], the overheat prevention correctionvalue γ[i], and the dither control correction value ε[i] is obtained. The product of the base injection amount QBSE, the air-fuel ratio feedback correction value FAF, and the air-fuel ratio learning value KG is multiplied by a value obtained by adding 1 to the above total. The product as thus obtained is calculated as the fuel injection amount Q[i] of each of the cylinders #1 to #4. As shown in the expression (1), when the air-fuel ratio feedback correction value FAF and the air-fuel ratio learning value KG exceed 1, the obtained value becomes a value for correcting and increasing the fuel injection amount, and when the air-fuel ratio feedback correction value FAF and the air-fuel ratio learning value KG fall below 1, the obtained value becomes a value for correcting and decreasing the fuel injection amount.

$$Q[i]=QBSE\times FAF\times KG\times(1+\alpha[i]+\beta[i]+\gamma[i]+\varepsilon[i]) \quad (1)$$

The air-fuel ratio feedback correction value FAF, the air-fuel ratio learning value KG, and the intake air distribution correction value α[i] are fuel injection amount correction values for compensating the deviation of the exhaust air-fuel ratio AF with respect to the target air-fuel ratio AFT. That is, QBSE×FAF×KG×(1+α[i]) represents a fuel injection amount required for achieving the target air-fuel ratio AFT in each of the cylinders #1 to #4. In contrast, the gas-blow correction value β[i], the overheat prevention correction value γ[i], and the dither control correction value ε[i] are correction values set for the respective cylinders for differentiating the air-fuel ratios of the cylinders #1 to #4. The expression (1) means that just an amount corresponding to the product obtained by multiplying the fuel injection amount required for achieving the target air-fuel ratio AFT by a value of the total of the gas-blow correction value β[i], the overheat prevention correction value γ[i], and the dither control correction value ε[i] is corrected. That is, the value of the total of the gas-blow correction value β[i], the overheat prevention correction value γ[i], and the dither control correction value ε[i] in each of the cylinders #1 to #4 corresponds to the difference in the air-fuel ratio of each of the cylinders #1 to #4 from the target air-fuel ratio AFT.

Air-Fuel Ratio Learning Value Updating Process

Subsequently, the detail of the air-fuel ratio learning value updating process P1 will be described.

Figure 3:
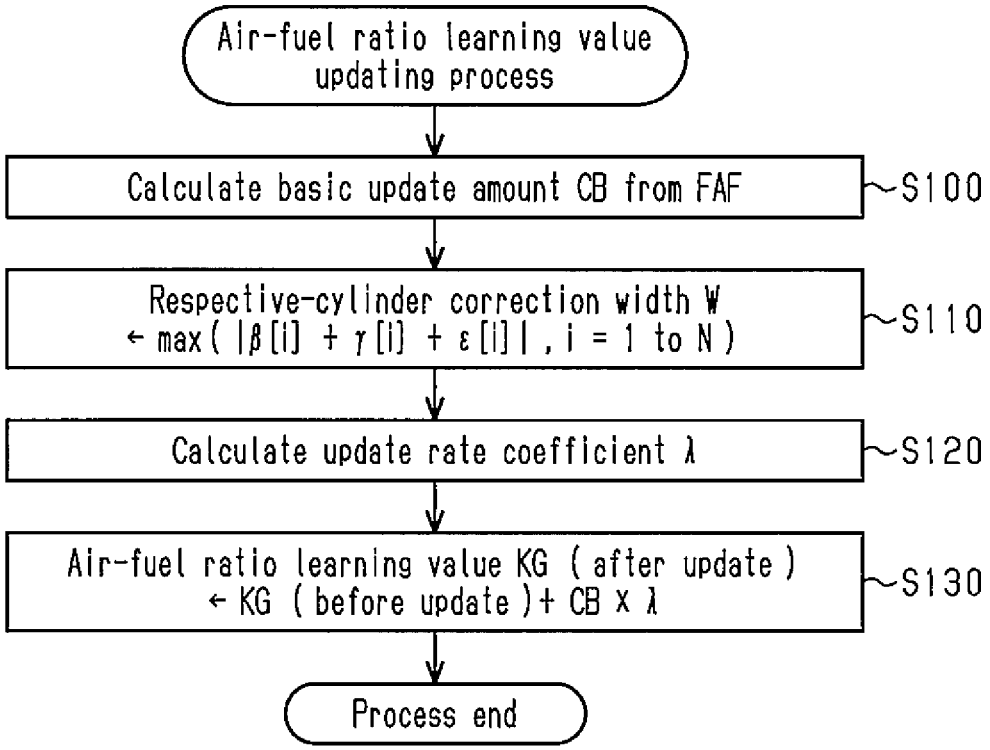
FIG. 3 is a flowchart of air-fuel ratio learning value updating process.

FIG. 3 shows a procedure of the air-fuel ratio learning value updating process Pl. The present process P1 is repeated in each preset control period during the operation of the engine 10, and executed by the arithmetic processing circuit 21 reading the program from the memory 22.

When the present process P1 is started, first in step S100, a basic update amount CB of the air-fuel ratio learning value KG is calculated from the air-fuel ratio feedback correction value FAF. When the air-fuel ratio feedback correction value FAF at this time exceeds 1, namely when the fuel injection amount is corrected to the increasing side, a positive value is calculated as the basic update amount CB. When the air-fuel ratio feedback correction value FAF at this time is smaller than 1, namely when the fuel injection amount is corrected to the decreasing side, a negative value is calculated as the basic update amount CB. At this time, the larger the difference of the air-fuel ratio feedback correction value FAF from 1, namely, the larger the amount of correction of the fuel injection amount Q[i] by the air-fuel ratio feedback correction value FAF, the larger absolute value the basic update amount CB is calculated to have.

Next, in step S110, the absolute value of the total of the gas-blow correction value β[i], the overheat prevention correction value γ[i], and the dither control correction value ε[i] of each of the cylinders #1 to #4 is obtained. Then, the respective-cylinder correction width W is set to the maximum value of the absolute values of the total of those correction values. The respective-cylinder correction width W as thus obtained corresponds to the maximum value of the amounts of deviation of the air-fuel ratios of the respective cylinders #1 to #4 with respect to the target air-fuel ratio AFT. In the present embodiment, this correction value width W of the respective cylinders is used as an index value of variation among respective-cylinder correction values of the cylinders.

Figure 4:
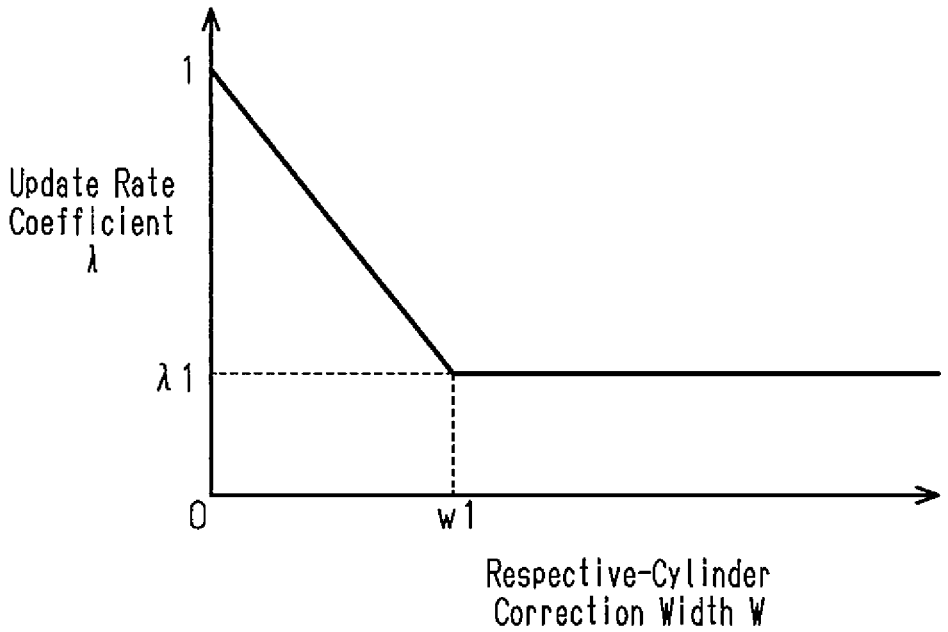
FIG. 4 is a graph showing the relationship between an update rate coefficient and a respective-cylinder correction width.

Subsequently, in step S120, an update rate coefficient λ is calculated based on the respective-cylinder correction width W. As shown in FIG. 4, when the respective-cylinder correction width W is 0, the update rate coefficient λ is calculated to be 1. Further, when the respective-cylinder correction width W is larger than or equal to a preset value w1, a preset positive value λ1 smaller than 1 is calculated as the update rate coefficient λ. When the respective-cylinder correction width W is in the range from 0 to w1, the update rate coefficient λ is calculated as a value for gradually decreasing from 1 to λ1 in accordance with the increase in the respective-cylinder correction width W from 0 to w1.

Thereafter, in step S130, the air-fuel ratio learning value KG is updated based on the basic update amount CB and the update rate coefficient λ, and then, the present process P1 this time ends. Due to the update of the air-fuel ratio learning value KG, the value after the update becomes the sum obtained by adding the product, obtained by multiplying the basic update amount CB by the update rate coefficient λ, to the value before the update. Therefore, the update rate in updating the air-fuel ratio learning value KG is lower when the update rate coefficient λ is set to a small value, than when the update rate coefficient λ is set to a large value.

The operation and advantages of the present embodiment will now be described.

In the fuel injection controller of the present embodiment, while the air-fuel ratio as the entire engine is maintained at the target air-fuel ratio AFT by using the three respective-cylinder correction values, which are the gas-blow correction value β[i], the overheat prevention correction value γ[i], and the dither control correction value ε[i], the air-fuel ratios of the respective cylinders #1 to #4 are differentiated, to correct the fuel injection amount Q[i] for the respective cylinders. The exhaust air-fuel ratio AF at the time of performing such correction for the respective cylinders fluctuates with the target air-fuel ratio AFT at the center. Further, the air-fuel ratio feedback correction value FAF also fluctuates together with the exhaust air-fuel ratio AF.

Thus, when the range of fluctuation of the exhaust air-fuel ratio AF which has occurred due to the correction for the respective cylinders is large, the convergence of the air-fuel ratio learning values KG deteriorates. The range of fluctuation of the exhaust air-fuel ratio AF at this time is proportional to the variation in air-fuel ratio among the cylinders. That is, in the present embodiment, the range of fluctuation of the exhaust air-fuel ratio AF is proportional to the variation in total value of the gas-blow correction value β[i], the overheat prevention correction value γ[i], and the dither control correction value ε[i] among the cylinders. In this respect, in the present embodiment, the respective-cylinder correction width W is set to the maximum value of the absolute values of the totals of those correction values. When the respective-cylinder correction width W is large, the update rate at the time of updating the air-fuel ratio learning value KG is made smaller than at the time when the respective-cylinder correction width W is small. Thus, when the fluctuation in the exhaust air-fuel ratio AF which occurs due to the correction for the respective cylinders is large, the followability and responsiveness of the air-fuel ratio learning value KG to the fluctuation of the exhaust air-fuel ratio AF become low. This can prevent deterioration in convergence of the air-fuel ratio learning values KG. Further, even when the correction of the fuel injection amount Q[i] for the respective cylinders is in operation to differentiate the air-fuel ratios of the respective cylinders #1 to #4, it is possible to continue to update the air-fuel ratio learning value KG.

The above-described embodiment may be modified as follows. The above-described embodiment and the following modifications can be combined as long as the combined modifications remain technically consistent with each other.

In the above embodiment, the absolute value of the value of total of the three respective-cylinder correction values, which are the gas-blow correction value β[i], the overheat prevention correction value γ[i], and the dither control correction value ε[i] of each of the cylinders #1 to #4 has been obtained, and further, the update rate (update rate coefficient λ) of the air-fuel ratio learning value KG has been set based on the maximum value of the absolute values of the total of those correction values. In place of this, the update rate of the air-fuel ratio learning value KG may be set based on the difference between the maximum value and the minimum value of the total of the three correction values of each of the cylinders #1 to #4. In short, the update rate of the air-fuel ratio learning value KG may be made lower when the variation among the respective-cylinder correction values of the cylinders is large and the fluctuation in the exhaust air-fuel ratio AF is large than when the variation among the respective-cylinder correction values of the cylinders is small and the fluctuation in the exhaust air-fuel ratio AF is small. This can prevent deterioration in convergence of the air-fuel ratio learning values KG due to the correction for the respective cylinders.

In the above embodiment, the setting has been made such that, when the respective-cylinder correction width W is in the range from 0 to the preset value w1, the update rate coefficient λ gradually decreases with increase in respective-cylinder correction width W, and when the respective-cylinder correction width W is in the range larger than or equal to than the preset value w1, the update rate coefficient λ becomes a fixed value (λ1). In place of this, if the update rate coefficient λ at the time when the respective-cylinder correction width W is large can be made smaller than the update rate coefficient λ at the time when the respective-cylinder correction width W is small, the setting aspect of the update rate coefficient λ may be changed as appropriate. For example, the update rate coefficient λ may be decreased in stages with increase in the update rate coefficient λ. Further, when the respective-cylinder correction width W is in the range exceeding the fixed value, the update rate coefficient λ may be set to 0 to stop the update of the air-fuel ratio learning value KG.

In the above embodiment, the fuel injection amount Q[i] for the respective cylinders has been corrected using the intake air distribution correction value α[i], so as to compensate the deviation of the air-fuel ratio among the cylinders due to the variation in intake air distribution. In place of this, when the variation in intake air distribution among the cylinders is not so large, the correction for the respective cylinders by using the intake air distribution correction value α[i] may be omitted.

The regular deviation of the air-fuel ratio due to the difference among the cylinders in strength of the exhaust gas blowing against the air-fuel ratio sensor 18 can be prevented by performing the correction of the fuel injection amount for the respective cylinders in the following aspect. The injection characteristics of each individual fuel injection valve 15 is measured in advance and in accordance with the measurement result, the gas-blow correction value β[i] of each of the cylinders #1 to #4 is set for each operation region of the engine 10. For example, there are cases where the fuel injection valve 15 with its air-fuel ratio being easily deviated to the rich side is installed in the cylinder with strong gas blow. In this case, the gas-blow correction value β[i] of each of the cylinders #1 to #4 is set such that the fuel injection amount is corrected and decreased in the cylinder with strong gas blow and the fuel injection amount is corrected and increased in the cylinder with weak gas blow. Further, there are also cases where the fuel injection valve 15 with its air-fuel ratio being easily deviated to the lean side is installed in the cylinder with strong gas blow. In this case, the gas-blow correction value β[i] of each of the cylinders #1 to #4 is set such that the fuel injection amount is corrected and increased in the cylinder with strong gas blow and the fuel injection amount is corrected and decreased in the cylinder with weak gas blow.

In the present embodiment, the three values which are the gas-blow correction value β[i], the overheat prevention correction value γ[i], and the dither control correction value ε[i] have been employed as the respective-cylinder correction values that are set for the respective cylinders in order to differentiate the air-fuel ratios of the respective cylinders #1 to #4. In place of this, one or two corrections value of those three correction values may be omitted. Further, a correction value except for the above values may be employed as the respective-cylinder correction value that is set for the respective cylinders in order to differentiate the air-fuel ratios of the respective cylinders #1 to #4.

The invention claimed is:

1. A fuel injection controller for an engine, the engine including a plurality of cylinders and a plurality of fuel injection valves provided respectively in the cylinders, wherein the fuel injection controller is configured to control each of fuel injection amounts of the fuel injection valves, the fuel injection controller is configured to have, as correction values for fuel injection amounts of the fuel injection valves, an air-fuel ratio feedback correction value, which is updated such that a difference between an exhaust air-fuel ratio, which is detected by an air-fuel ratio sensor installed in an exhaust passage, and a target air-fuel ratio approaches zero, an air-fuel ratio learning value, which is updated based on the air-fuel ratio feedback correction value such that an amount of correction of the fuel injection amount according to the air-fuel ratio feedback correction value approaches zero, and respective-cylinder correction values, which are set for the respective cylinders to differentiate the air fuel ratios of the cylinders, and the fuel injection controller is configured to make an update rate of the air-fuel ratio learning value lower when a variation among the respective-cylinder correction values of the cylinders is great than when the variation among the respective-cylinder correction values of the cylinders is small.

2. The fuel injection controller for an engine according to claim 1, wherein the respective-cylinder correction value is a gas-blow correction value for compensating a regular deviation of an air-fuel ratio due to a difference in exhaust gas blowing against the air-fuel ratio sensor among the cylinders.

3. The fuel injection controller for an engine according to claim 1, wherein the respective-cylinder correction value is a catalyst overheat prevention correction value for limiting a temperature rise of a catalyst device installed in the exhaust passage.

4. The fuel injection controller for an engine according to claim 1, wherein the respective-cylinder correction value is a dither control correction value for promoting a temperature rise of a catalyst device installed in the exhaust passage.

5. A fuel injection controller for an engine, the engine including a plurality of cylinders and a plurality of fuel injection valves provided respectively in the cylinders, the fuel injection controller comprising circuitry that is configured to control each of fuel injection amounts of the fuel injection valves, have, as correction values for fuel injection amounts of the fuel injection valves, an air-fuel ratio feedback correction value, which is updated such that a difference between an exhaust air-fuel ratio, which is detected by an air-fuel ratio sensor installed in an exhaust passage, and a target air-fuel ratio approaches zero, an air-fuel ratio learning value, which is updated based on the air-fuel ratio feedback correction value such that an amount of correction of the fuel injection amount according to the air-fuel ratio feedback correction value approaches zero, and respective-cylinder correction values, which are set for the respective cylinders to differentiate the air fuel ratios of the cylinders, and make an update rate of the air-fuel ratio learning value lower when a variation among the respective-cylinder correction values of the cylinders is great than when the variation among the respective-cylinder correction values of the cylinders is small.

6. A fuel injection controlling method for an engine, the engine including a plurality of cylinders and a plurality of fuel injection valves provided respectively in the cylinders, the method comprising:

controlling each of fuel injection amounts of the fuel injection valves;

having, as correction values for fuel injection amounts of the fuel injection valves, an air-fuel ratio feedback correction value, which is updated such that a difference between an exhaust air-fuel ratio, which is detected by an air-fuel ratio sensor installed in an exhaust passage, and a target air-fuel ratio approaches zero, an air-fuel ratio learning value, which is updated based on the air-fuel ratio feedback correction value such that an amount of correction of the fuel injection amount according to the air-fuel ratio feedback correction value approaches zero, and respective-cylinder correction values, which are set for the respective cylinders to differentiate the air fuel ratios of the cylinders; and making an update rate of the air-fuel ratio learning value lower when a variation among the respective-cylinder correction values of the cylinders is great than when the variation among the respective-cylinder correction values of the cylinders is small.

* * * * *